US005876560A

United States Patent [19]

Gustavsson et al.

[11] Patent Number: 5,876,560

[45] Date of Patent: Mar. 2, 1999

[54] METHOD AND APPARATUS FOR REMOVING GAS FROM A FIBRE-LIQUID SUSPENSION

[75] Inventors: Lennart Gustavsson; Bo Svanegård, both of Karlstad, Sweden

[73] Assignee: Kvaerner Pulping Technologies Aktiebolag, Karlstad, Sweden

[21] Appl. No.: 596,126

[22] PCT Filed: Sep. 26, 1994

[86] PCT No.: PCT/SE94/00883

§ 371 Date: Feb. 9, 1996

§ 102(e) Date: Feb. 9, 1996

[87] PCT Pub. No.: WO95/11337

PCT Pub. Date: Apr. 27, 1995

[30] Foreign Application Priority Data

Oct. 20, 1993 [SE] Sweden ..... 9303451

[51] Int. Cl.[6] ..... D21D 5/26; C02F 1/20

[52] U.S. Cl. ..... 162/53; 95/247; 95/266; 96/195

[58] Field of Search ..... 162/53; 95/247, 95/260, 266; 96/194, 195

[56] References Cited

U.S. PATENT DOCUMENTS

| | | | |
|---|---|---|---|
| 2,571,219 | 10/1951 | De Cew | 95/260 |
| 4,198,266 | 4/1980 | Kirk et al. | 162/29 |
| 4,684,442 | 8/1987 | Meredith et al. | 162/242 |
| 5,217,575 | 6/1993 | Backlund | 162/65 |

FOREIGN PATENT DOCUMENTS

| | | |
|---|---|---|
| 647528 | 8/1962 | Canada . |
| 158366 | 3/1957 | Sweden . |
| 190983 | 8/1964 | Sweden . |

*Primary Examiner*—Stanley S. Silverman
*Assistant Examiner*—Dean T. Nguyen
*Attorney, Agent, or Firm*—Dorsey & Whitney LLP

[57] ABSTRACT

The invention relates to a method and arrangement for removing gas from a fibre/liquid suspension in a fibre treatment line in a pulp mill, which line includes at least one stage in which the fibre/liquid suspension is treated and/or stored in a large container (2) before being conveyed for further treatment. The fibre/liquid suspension is conveyed to the large container via a vessel (15) which with its lower part communicates with the large container and has a significantly smaller horizontal sectional area than the large container, but extends upwards above the level (4) of the fibre/liquid suspension in the large container, with gas being removed from the fibre/liquid suspension (19) in the area (18) of the upper part of the smaller vessel by means of the area being subjected to a subatmospheric pressure.

27 Claims, 1 Drawing Sheet

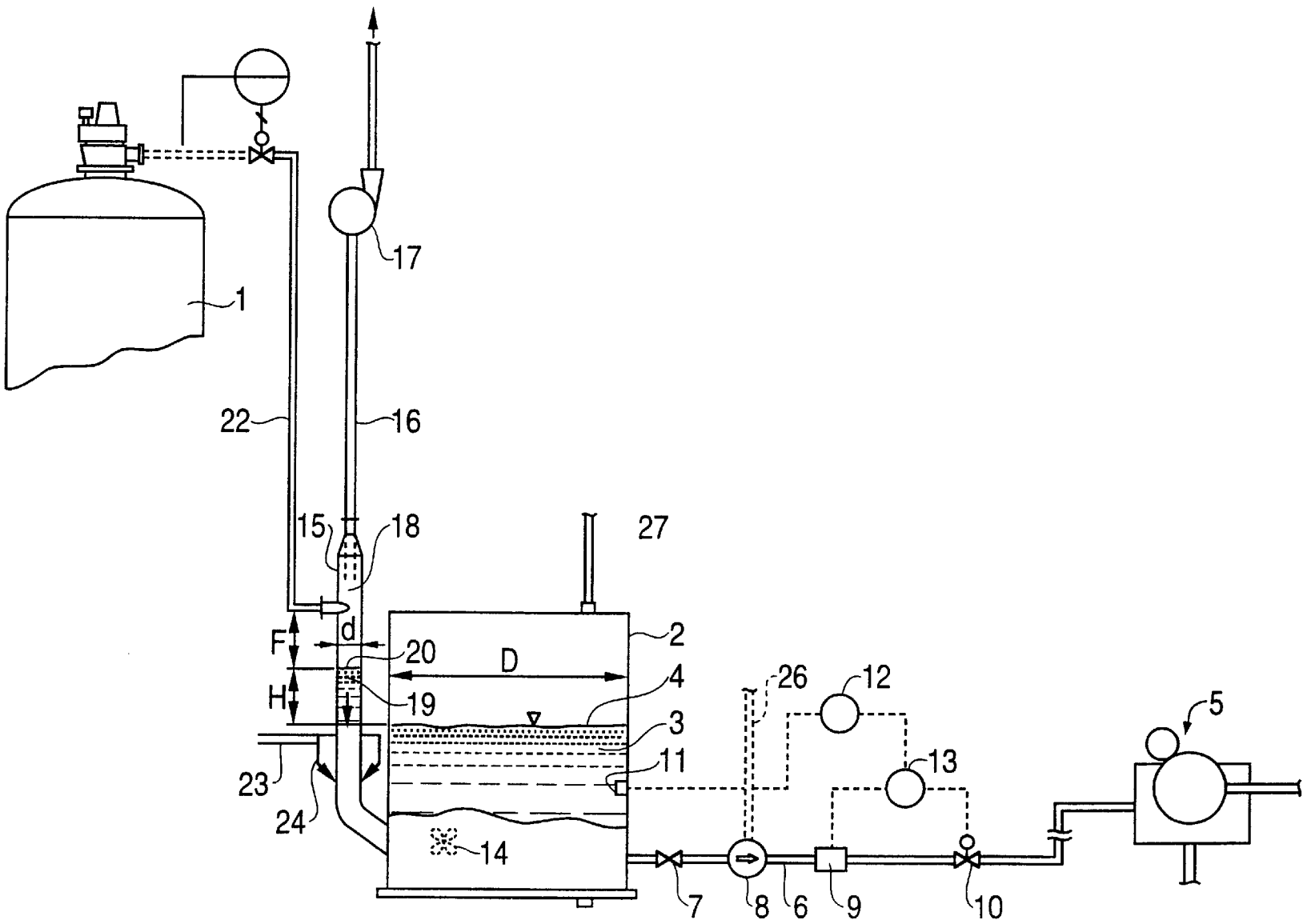
5
10
13
12
9
26
6
8
7
27
2
4
3
11
D
14
17
16
18
20
19
d
15
F
H
24
23
22
1

METHOD AND APPARATUS FOR REMOVING GAS FROM A FIBRE-LIQUID SUSPENSION

BACKGROUND OF THE INVENTION

1. Field of the Invention

The invention relates to a method and arrangement for removing gas from a fibre/liquid suspension in a fibre treatment line in a pulp mill, which line includes at least one stage in which the fibre/liquid suspension is treated and/or stored in a large container before being conveyed for further treatment.

2. Description of the Prior Art

It is commonly known that gas bubbles in fibre/liquid suspensions, whether the bubbles occur as free bubbles in the liquid between the fibers or as bubbles bound to the fibers, can lead to problems in different phases of the fibre treatment process. The nature of the problems varies in different parts of the fibre treatment line in the pulp mill, such as interruptions in the flow of the suspension through valves, screens, and so forth, and fibre flocculation, foaming, dewatering problems, and so forth. Also, in a subsequent paper-making machine, the occurrence of gas bubbles in the suspension can cause problems.

The gas in question can, for example, be air, oxygen, and the like. In general it is a question of various gas mixtures The problem has been addressed in different ways in the prior art. For example, it is known to remove the gas from pumps which transport the suspension between the various treatment stations of the fibre treatment line. However, the capacity of these pumps to remove gas is limited, and this is particularly so when the pump is intended to transport very large flows of fibre/liquid suspension. It is also known to remove gases from large containers in the fibre treatment line, in which containers the fibre/liquid suspension is stored for a long period in order to be stirred and homogenized, for example, or subjected to another treatment. However, the subatmospheric pressure which is needed in such a container in order to achieve the desired degassing requires that the walls of the container be strengthened to such an extent that the overall construction becomes very expensive, which is an obvious disadvantage.

SUMMARY OF THE INVENTION

An object of the invention is to provide a method and an arrangement for removing gas, efficiently and by relatively simple means, from a fibre/liquid suspension in a fibre treatment line in a pulp mill, which line includes at least one stage in which the fibre/liquid suspension is treated and/or stored in a large container before being conveyed onward for further treatment. According to the invention, the fibre/liquid suspension is conveyed to a large container via a vessel which with its lower part communicates with the large container and has a significantly smaller horizontal sectional area than the large container, but extends upwards above the level of the fibre/liquid suspension in the large container, with gas being removed from the fibre/liquid suspension in the area of the upper part of the smaller vessel by means of the area being subjected to a sub-atmospheric pressure. As a result of the significantly smaller horizontal sectional area, important design advantages are achieved from a strength point of view, as compared with dimensioning the large container to take account of the subatmospheric pressure chosen for the gas removal.

The internal horizontal cross-sectional area of the smaller vessel is preferably at least less than 1/10 of the corresponding area in the large container, preferably less than 1/20.

The level of the fibre/liquid suspension in the large container is preferably kept essentially constant, while the level of the fibre/liquid suspension in the smaller vessel is kept at a higher level than the level in the large container by means of being sucked up by the subatmospheric pressure in the area. The liquid column represented by the difference in level corresponds essentially to the subatmospheric pressure in the area in the smaller vessel. The subatmospheric pressure can amount to a water column of between 0.5 and 2 m, preferably to a water column of between 0.8 and 1.8 m, and expediently to a water column of between 1 and 1.5 m.

When the fibre/liquid suspension is introduced into the smaller vessel, it can have a concentration of 5–25% fibre pulp, preferably 6–18% fibre pulp, and expediently 8–12% fibre pulp (dry matter content), and before it is introduced into the large container, the suspension can be diluted to half this concentration. The percentage contents refer to percent by weight of fibers in the fibre/liquid suspension. Thus, according to the invention, the degassing is preferably carried out when the suspension has a relatively high pulp concentration, this being favourable for a good gas separation effect.

The fibre/liquid suspension is expediently conveyed to the smaller vessel at a certain height above the free surface of the fibre/liquid suspension in the vessel, which means that the suspension can fall freely down through the area which is exposed to subatmospheric pressure. By means of the suspension being introduced into the area of subatmospheric pressure and by means of its falling freely through this area, a desired flashing effect is obtained, which can further enhance the degassing effect. The height of the free fall can amount to between 0.2 and 2 m, and preferably to between 0.5 and 1.5 m. The suspension can have a temperature within, for example, a temperature range of 85°–95° C. when it is introduced into the smaller vessel.

The pressure in the large container above the surface of the fibre/liquid suspension preferably corresponds at least almost to the surrounding atmospheric pressure.

The greater part of the gas in the suspension is preferably removed in the smaller vessel before the suspension is introduced into the large container. A substantial part of the gas remaining in the suspension can be removed in at least one stage following the large container, for example in a pump according to a technique which is known per se. This is possible even in the case of relatively large flows of fibre/liquid suspension, since the greater part of the gas has been removed in the smaller vessel ahead of the large container, so that only marginal quantities of gas are required to be removed in the downstream pump. By means of this combination, it is possible to achieve a very high overall degassing effect, involving a maximum of 2% by volume, and preferably a maximum of 1% by volume, of gas in the suspension.

Further characteristics, aspects and advantages of the invention will become clear from the subsequent patent claims and from the description, which follow, of a possible application and at the same time of a preferred embodiment of the invention.

BRIEF DESCRIPTION OF THE DRAWING

In the following description, reference is made to the FIGURE which illustrates diagrammatically the application of the invention in oxygen delignification for removing oxygen from a fibre pulp suspension coming from an oxygen reactor.

DETAILED DESCRIPTION OF THE PREFERRED EMBODIMENT

In the FIGURE, an oxygen reactor is designated by the reference 1, and a so-called blow tank by the reference 2. A fibre pulp suspension 3 remains in the blow tank 2 for a period on an average of 15 min. The suspension is stirred using an agitator 14. The pressure in the container 2 above the surface 4 of the fibre pulp suspension 3 corresponds to the surrounding atmospheric pressure or to a pressure which is so slightly subatmospheric that it does not have any significant influence on the strength-related dimensioning of the container. According to the embodiment, the pulp concentration in the container 2 is approximately 5% by weight. The container 2 normally has an internal diameter D which can amount to 5 to 10 m.

From the container 2, the suspension 3 is conveyed onward for further treatment, for example, to a washing machine 5 which can consist of a washing press. In the line 6 to the washing machine 5, there are a shut-off valve 7, an MC pump 8 (centrifugal pump for pumping pulp of medium consistency), a flow meter 9 and a control valve 10. The level 4 in the container 2 is kept constant with the aid of a sensor 11 and the flow meter 9 which regulate the control valve 10 via measurement transducers 12, 13.

According to the invention, a smaller vessel 15 is arranged on the inlet side of the large container 2. The vessel 15 is in the form of a cylindrical column with a diameter d which is very much smaller than the diameter D in the large container 2. While D can amount to 5 to 10 m, d can be of the order of magnitude of 1 m, which means that the horizontal inner cross-sectional area of the small vessel 15 is very much smaller than the corresponding area in the large container 2.

The small vessel or column 15 is arranged alongside or at a short distance from the large container 2. The distance is preferably 1 m maximum, and expediently 0.5 m. The vessel 15 extends upwards from a level near the bottom of the large container 2 to a point above the top of the container 2. The vessel 15 and the container 2 communicate with one another without any constriction.

The upper part of the small vessel or column 15 is connected via a line 16 to a blowing fan 17 which creates a subatmospheric pressure in the area 18 in the upper part of the vessel 15. The subatmospheric pressure in the area 18 means that the fibre/liquid suspension 19 in the vessel 15 is sucked up a distance H above the level 4 in the large container 2. The upper level of the fibre/liquid suspension 19 in the vessel 15 has been designated 20. The level difference H thus corresponds to the subatmospheric pressure in the area 18.

The fibre/liquid suspension is introduced into the vessel 15 through a line 22 at a height F above the free liquid surface 20. The suspension has a temperature of approximately 90° C. and a pulp concentration of approximately 10% when it is introduced into the vessel 15. The liquid consists principally of water. At a level below the free surface 20, dilution water is added to the suspension in the vessel 15 through a line 23 via downwardly inclined nozzles 24, so that, after degassing has taken place, the suspension acquires the desired concentration before being conveyed into the large container 2.

Gas is removed from the fibre/liquid suspension by means of the subatmospheric pressure in the area 18 in the smaller vessel 15. The gas in this case consists predominantly of oxygen. The degassing is stimulated by means of the flashing effect when the high-concentration pulp enters the vessel 15 in the area 18 which is subjected to subatmospheric pressure, and also by means of the pulp falling freely (the distance F) down towards the free surface.

If appropriate, a supplementary degassing can be carried out in a manner known per se by removing gas from the centrifugal pump 8 through a line 26 from the centre of the pump. The large container 2 is connected via a line 27 to an apparatus for handling odorous gases at essentially atmospheric pressure, if appropriate via a low-energy blowing fan which creates a slightly subatmospheric pressure in the container 2.

We claim:

1. A method for removing gas from a fibre/liquid suspension in a fibre treatment line in a pulp mill, which line includes at least one stage in which the fibre/liquid suspension is treated and/or stored in a large container before being conveyed for further treatment, wherein the fibre/liquid suspension is conveyed to the large container via a smaller vessel which with its lower part is connected to the large container and has a significantly smaller horizontal sectional area than the large container, and has an upper part which extends upwards above a top level of the fibre/liquid suspension in the large container, and wherein gas is removed from the fibre/liquid suspension in an area of the upper part of the smaller vessel by means of the area being subjected to a subatmospheric pressure.

2. The method according to claim 1, wherein the top level of the fibre/liquid suspension in the large container is kept at an essentially constant height, a top level of the fibre/liquid suspension in the smaller vessel is kept at a higher level than the top level in the large container by means of being sucked up by the subatmospheric pressure in said area of the upper part of the smaller vessel, and wherein the liquid column represented by the level difference between said two top levels corresponds essentially to the subatmospheric pressure in said area of the upper part of the smaller vessel.

3. The method according to claim 1, wherein the subatmospheric pressure amounts to a water column of between 0.5 and 2 m.

4. The method according to any one of claims 1–3, wherein the fibre/liquid suspension is introduced into the smaller vessel at a certain height above the top level of the fibre/liquid suspension in the smaller vessel in the area of said subatmospheric pressure in such a way that at least a certain flashing effect is obtained as the suspension enters the smaller vessel, and the fibre/liquid suspension is made to fall freely through said area towards the top level of the fibre/liquid suspension in the smaller vessel.

5. The method according to any one of claims 1–3, wherein the fibre/liquid suspension is conveyed from the smaller vessel to the large container without passing any significant constriction.

6. The method according to any one of claims 1–3, wherein the fibre/liquid suspension contains, in % by weight, 5–25% fibre pulp, when it is introduced into the smaller vessel.

7. The method according to any one of claims 1–3, wherein the fibre/liquid suspension has a temperature of between 85° and 95° C. when it is introduced into the smaller vessel.

8. The method according to any one of claims 1–3, wherein the greater part of the gas in the suspension is removed from said smaller vessel before the suspension is introduced into the large container, and a substantial part of the remainder is removed in at least one stage following the large container.

9. The method according to any one of claim 1–3, wherein the suspension consists of a fibre/liquid suspension from an oxygen reactor in which the fibre has been subjected to oxygen treatment, and the gas which is removed consists mainly of oxygen.

10. The method according to claim 3, wherein said subatmospheric pressure amounts to a water column of between 0.8 and 1.8 m.

11. The method according to claim 3, wherein said subatmospheric pressure amounts to a water column of between 1 and 1.5 m.

12. The method according to claim 4, wherein the fibre/liquid suspension is conveyed from the smaller vessel to the large container without passing any significant constriction.

13. The method according to claim 4, wherein the fibre/liquid suspension contains, in % by weight, 5–25% fibre pulp, when it is introduced into the smaller vessel.

14. The method according to claim 5, wherein the fibre/liquid suspension contains, in % by weight, 5–25% fibre pulp, when it is introduced into the smaller vessel.

15. The method according to claim 6, wherein the fibre/liquid suspension is diluted with water which enters the smaller vessel at a level below the top level of the fibre/liquid suspension in the smaller vessel, once the fibre/liquid suspension has been degassed in the vessel, before the suspension is introduced into the large container.

16. The method according to claim 15, wherein the height of the free fall of the fibre/liquid suspension in the smaller vessel, in the area of the subatmospheric pressure, towards the top level of the suspension in the smaller vessel amounts to between 0.2 and 2 m.

17. The method according to claim 16, wherein the height of the free fall of the fibre/liquid suspension in the smaller vessel, in the area of the subatmospheric pressure, towards the top level of the suspension in the smaller vessel amounts to between 0.5 and 1.5 m.

18. The method according to claim 16, wherein the pressure in the large container corresponds at least almost to the surrounding atmospheric pressure.

19. The method according to claim 6, wherein the fibre/liquid suspension contains, in % by weight, 6–18% fibre pulp when it is introduced into the smaller vessel.

20. The method according to claim 6, wherein the fibre/liquid suspension contains, in % by weight, 8–12% fibre pulp when it is introduced into the smaller vessel.

21. An arrangement for removing gas from a fibre/liquid suspension in a fibre treatment line in a pulp mill, which line includes at least one stage in which the fibre/liquid suspension is treated and stored in a large container before being conveyed onward for further treatment, wherein a smaller vessel is connected to the large container at a lower part of said vessel and has a significantly smaller horizontal sectional area than the large container, and has an upper part which extends upwards above a tope level of the fibre/liquid suspension in the large container, the means for subjection the upper part of the smaller vessel to a subatmospheric pressure in order to remove gas from the suspension in the smaller vessel.

22. An arrangement according to claim 21, wherein an inlet line for the fibre/liquid suspension to the smaller vessel opens into the upper part of the smaller vessel at a height above the top level of the suspension in the smaller vessel, and there is no significant constriction in the connection between the lower part of the smaller vessel and the large container.

23. An arrangement according to claim 21 or 22, wherein the horizontal inner cross-sectional area of the smaller vessel is less than 1/10 of the corresponding area in the large container.

24. An arrangement according to claim 23, wherein the horizontal inner cross-sectional area of the smaller vessel is less than 1/20 of the corresponding area in the large container.

25. An arrangement according to claim 21 or 22, wherein the smaller vessel is arranged as a column alongside and at a short distance from the large container.

26. A method for removing gas from a fiber/liquid suspension in a fiber treatment line in a pulp mill, which line includes at least one stage in which the fiber/liquid suspensions treated and/or stored in a large container before being conveyed for further treatment, the method comprising the steps of:

conveying the fiber/liquid suspension to the large container via a smaller vessel which has its lower part connected to the large container, has a significantly smaller horizontal sectional area than the large container, and has an upper part which extends upwardly above a tope level of the fiber/liquid suspension in the large container;

removing gas from the fiber/liquid suspension in an area of the upper part of the smaller vessel by subjecting the area to a subatmospheric pressure;

conveying the fiber/liquid suspension from the smaller vessel to the large container without passing any significant constriction; and diluting the fiber/liquid suspension with water in the smaller vessel at a level below the top level of the fiber/liquid suspension in the smaller vessel before the suspension is conveyed into the large container.

27. An arrangement of removing gas from a fiber/liquid suspension and adjusting the fiber concentration of the suspension in a fiber treatment line in a pulp mill, which line includes at least one stage in which the fiber/liquid suspension is treated and stored in a large container before being conveyed onward for further treatment, the arrangement comprising:

a smaller vessel connected to the large container at a lower part of said vessel with no significant constriction in the connection between the lower part of the smaller vessel and the large container, said vessel having a significantly smaller horizontal sectional area then the large container, said vessel having an upper part which extends upwards above a top level of the fiber/liquid suspension in the large container;

a means for subjecting the upper part of the smaller vessel to a subatmospheric pressure in order to remove gas from the suspension in the smaller vessel;

a first inlet line for introducing the fiber/liquid suspension to the smaller vessel opening into the upper part of the smaller vessel at a height above the top level of the suspension in the smaller vessel; and a second inlet line for diluting liquid which opens into the smaller vessel below the top level of the suspension in the smaller vessel for adjusting the fiber concentration of the degassed suspension before the suspension enters the large container.

* * * * *